US010948182B2

(12) United States Patent
Hilber et al.

(10) Patent No.: US 10,948,182 B2
(45) Date of Patent: Mar. 16, 2021

(54) COMBUSTION SYSTEM FOR A BOILER

(71) Applicant: GENERAL ELECTRIC TECHNOLOGY GMBH, Baden (CH)

(72) Inventors: Thomas Hilber, Kernen-Stetten (DE); Thomas Wild, Waldenbuch (DE); Dragisa Ristic, Wendlingen (DE); Noel Francon, Stuttgart (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 621 days.

(21) Appl. No.: 14/934,221

(22) Filed: Nov. 6, 2015

(65) Prior Publication Data

US 2016/0153657 A1 Jun. 2, 2016

(30) Foreign Application Priority Data

Nov. 28, 2014 (EP) ..... 14195352

(51) Int. Cl.

| | |
|---|---|
| ***F23D 99/00*** | (2010.01) |
| ***F23D 1/00*** | (2006.01) |
| ***F23C 7/02*** | (2006.01) |
| ***F23D 14/04*** | (2006.01) |
| ***F23D 23/00*** | (2006.01) |

(52) U.S. Cl.

CPC ..... *F23D 91/04* (2015.07); *F23C 7/02* (2013.01); *F23D 1/00* (2013.01); *F23D 14/04* (2013.01); *F23D 23/00* (2013.01); *F23C 2201/101* (2013.01); *F23C 2900/06041* (2013.01); *F23D 2201/20* (2013.01)

(58) Field of Classification Search

CPC ..... F23C 2201/101; F23C 7/02; F23C 2900/06041; F23C 5/08; F23C 7/00; F23D 91/04; F23D 1/00; F23D 14/04; F23D 23/00; F23D 2201/20; F23D 2900/00003; F23K 3/02; F23K 2203/006; F23K 2203/008

USPC ..... 431/12, 6

See application file for complete search history.

(56) References Cited

U.S. PATENT DOCUMENTS 1,874,488 A * 8/1932 Franklin ..... F23D 1/02 110/104 R
2,363,875 A * 11/1944 Kreisinger ..... F22G 5/02 122/479.1

(Continued)

FOREIGN PATENT DOCUMENTS

GB 852498 A 10/1960
JP 11281010 A * 10/1999

(Continued)

*Primary Examiner* — Jorge A Pereiro
(74) *Attorney, Agent, or Firm* — Grogan, Tuccillo & Vanderleeden, LLP

(57) ABSTRACT

The present disclosure relates to a system and a method for combustion of solid fuels. The combustion system includes burners which supply a mixed flow of fuel and air through a fuel nozzle to the combustion chamber for example of a boiler. The mixed flow of fuel and primary air is supplied to the burner through a duct from a pulverizer where the fuel is grinded to the required finesse. The duct further bends in such a way that one portion is vertical with respect parallel to axis of the boiler 1 A-A is vertical duct and other portion is horizontal duct which is parallel to axis B-B of the fuel nozzle.

19 Claims, 4 Drawing Sheets

(56) References Cited

U.S. PATENT DOCUMENTS 2,575,885 A * 11/1951 Mittendorf ..... F22G 5/02 122/479.1
2,608,168 A * 8/1952 Jackson ..... F23D 1/00 431/176
2,649,079 A * 8/1953 Van Brunt ..... F22G 5/20 122/479.1
2,851,018 A * 9/1958 Heller ..... F22G 5/02 122/479.2
3,250,236 A * 5/1966 Zelinski ..... F23D 1/00 110/265
3,568,612 A * 3/1971 Stookey ..... F23D 14/00 110/266
3,788,796 A * 1/1974 Krippene ..... F23C 7/008 431/2
4,150,631 A * 4/1979 Frey ..... F23C 5/32 110/186
4,231,262 A * 11/1980 Boll ..... G01F 1/74 73/861.04
4,252,069 A * 2/1981 McCartney ..... F23C 5/06 110/104 B
4,304,196 A * 12/1981 Chadshay ..... F23C 5/32 122/449
4,457,241 A * 7/1984 Itse ..... F23D 1/02 110/261
4,459,922 A * 7/1984 Chadshay ..... F23K 3/02 110/263
4,479,442 A * 10/1984 Itse ..... F23D 1/02 110/104 R
4,497,263 A * 2/1985 Vatsky ..... F23K 3/02 110/106
4,517,904 A * 5/1985 Penterson ..... F23C 5/08 110/264
4,669,398 A * 6/1987 Takahashi ..... F23C 7/00 110/263
4,715,301 A * 12/1987 Bianca ..... F23C 5/32 110/264
4,907,962 A * 3/1990 Azuhata ..... F23C 7/004 110/262
5,231,937 A * 8/1993 Kobayashi ..... C04B 7/44 110/262
5,441,000 A * 8/1995 Vatsky ..... F23C 5/32 110/265
5,461,990 A * 10/1995 Newman ..... F23C 5/06 110/261
5,464,344 A 11/1995 Hufton
5,623,884 A * 4/1997 Penterson ..... F23C 5/00 110/234
5,662,464 A * 9/1997 LaRose ..... F23C 7/02 431/8
5,727,480 A * 3/1998 Garcia-Mallol ..... F23C 6/045 110/203
5,746,143 A * 5/1998 Vatsky ..... F23C 5/06 110/260
5,806,443 A * 9/1998 Kobayashi ..... F23C 7/006 110/262
6,112,676 A * 9/2000 Okazaki ..... F23D 1/00 110/261
6,120,281 A 9/2000 Vatsky
6,148,743 A * 11/2000 Vatsky ..... F23L 9/00 110/264
6,237,510 B1 * 5/2001 Tsumura ..... F23D 1/00 110/262
6,237,513 B1 * 5/2001 Tobiasz ..... F23C 5/32 110/348
6,260,491 B1 * 7/2001 Grusha ..... F23D 1/00 110/261
2003/0091948 A1 * 5/2003 Bool, III ..... F23C 7/004 431/10
2003/0104328 A1 * 6/2003 Kobayashi ..... F23D 14/24 431/10
2004/0211345 A1 * 10/2004 Okazaki ..... F23C 6/045 110/261
2005/0120927 A1 * 6/2005 Okazaki ..... F23D 1/00 110/261
2006/0040223 A1 * 2/2006 Ghani ..... F23C 3/008 431/9
2009/0277364 A1 * 11/2009 Donais ..... F23C 7/008 110/263
2011/0033807 A1 2/2011 Wang et al.
2012/0103237 A1 * 5/2012 Jones ..... F23D 1/00 110/297
2012/0152158 A1 * 6/2012 Matsumoto ..... F23D 1/00 110/347
2013/0098278 A1 4/2013 Wang et al.
2014/0290544 A1 * 10/2014 Wild ..... F23D 1/00 110/265
2015/0226431 A1 * 8/2015 Ristic ..... F23Q 3/00 431/6
2015/0241058 A1 * 8/2015 Mine ..... F23D 1/00 110/261
2016/0061446 A1 * 3/2016 Hilber ..... F23C 5/08 110/347
2016/0146463 A1 * 5/2016 Kiyama ..... F23L 9/04 110/214
2017/0045218 A1 * 2/2017 Ristic ..... F23K 3/02
2017/0356643 A1 * 12/2017 Ristic ..... F23D 1/00

FOREIGN PATENT DOCUMENTS

JP 2010 270992 A 12/2010
JP 2010 270993 A 12/2010
JP 2014-55759 A 3/2014
WO 2014/027611 A1 2/2014

* cited by examiner

COMBUSTION SYSTEM FOR A BOILER

CROSS-REFERENCE TO RELATED APPLICATIONS

This application claims priority to EP Application No. 14195352.1 filed Nov. 28, 2014, the contents of which are hereby incorporated in its entirety.

TECHNICAL FIELD

The present disclosure relates to a combustion system and more particularly a combustion system that is part of a boiler for electric power generation.

BACKGROUND

Boilers for electric power generation often have combustion systems with furnaces that are fired with solid fuel, such as bituminous coal, lignite, biomass, etc.; these combustion systems are usually provided with mills and ducting for supplying the pulverized fuel to one or more burners. Combustion system for lignite coals commonly operate in such way that the nitrogen oxide emissions (NOx) are achieved without application of secondary measures such as selective catalytic reduction (SCR) or selective non-catalytic reduction (SNCR) technology. The current limits in Europe referred to NOx emission are less than 200 mg/m$^3$ (dry flue gas, reference 6% Oxygen ($O_2$), measured as Nitrogen dioxide ($NO_2$)).

Generally, during the combustion process of fossil fuels pollutants such as Nitrogen oxides (NOx) are generated. If allowed to enter the atmosphere, these pollutants can detrimentally impact the environment and pose health hazards to humans and animals. U.S. Pat. No. 4,669,398 discloses a pulverized a fuel firing apparatus comprising a pulverized fuel injection compartment so constructed that the combined amount of primary air and secondary air to be consumed is less than the theoretical amount of air required for the combustion of the pulverized fuel, a second pulverized fuel injection compartment so constructed that the combined primary and secondary air amount is substantially equal to the theoretical air for the pulverized fuel, and a supplementary air compartment for injecting supplementary air into the furnace. The three compartments are arranged close to one another and control the NOx production upon combustion of the pulverized fuel.

State-of-the-art combustion systems for lignite are designed to achieve the actual NOx emission limits of less than 200 mg/m$^3$. It is likely that soon more stringent norms will be applicable. Consequently there is need to provide combustion systems which achieve actual emissions level much less than 200 mg/m$^3$.

SUMMARY

The present disclosure describes a system and a method for combustion of solid fuels that will be presented in the following simplified summary to provide a basic understanding of one or more aspects of the disclosure that are intended to overcome the discussed drawbacks, but to include all advantages thereof, along with providing some additional advantages. This summary is not an extensive overview of the disclosure. It is intended to neither identify key or critical elements of the disclosure, nor to delineate the scope of the present disclosure. Rather, the sole purpose of this summary is to present some concepts of the disclosure, its aspects and advantages in a simplified form as a prelude to the more detailed description that is presented hereinafter An object of the present disclosure is to propose a system and a method for combustion of solid fuels which can be used in existing and in new installations, in particular in coal or biomass fired boilers, and which significantly reduce the emission of pollutants, primarily Nitrogen oxides (NOx) and to improve part-load operability of burners of the combustion system.

The present invention offers a technical solution for both improved (NOx) emission and improved part-load operability of the burners. The combustion system is able to create a fuel-rich phase in the center of a fuel nozzle. The concentration of the solid fuel in the center allows operation of the burners with minimum NOx emissions. By adopting this means the burners operate as a Low NOx burners. A further aspect of the present disclosure includes tilted secondary air nozzles. The tilted secondary air nozzles allow influencing the combustion process. By adopting this means it is possible to further reduce NOx emissions and improve flame stability during start-up or part load operation of the burners. Various other objects and features of the present disclosure will be apparent from the following detailed description and claims.

According to aspects disclosed herein, there is provided a system for combustion having at least one burner to supply a mixed flow of fuel and primary air through at least one fuel nozzle to a combustion chamber. Further a fuel concentrator concentrates the mixed flow of fuel and primary air in centre of the at least one fuel nozzle. Secondary air nozzles arranged above and below the at least one fuel nozzle to inject secondary air in order to maintain a stable in the combustion chamber.

The present disclosure also refers to a method for combustion:

- supplying a mixed flow of fuel and primary air by at least one burner through at least one fuel nozzle to a combustion chamber;
- concentrating the mixed flow of fuel and primary air in centre of the at least one fuel nozzle with a fuel concentrator;
- injecting secondary air in order to control the combustion of the mixed flow of fuel and primary air in the combustion chamber through secondary air nozzles which are arranged above and below the at least one fuel nozzle.

These together with the other aspects of the present disclosure, along with the various features of novelty that characterize the present disclosure, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will be better understood with reference to the following detailed description and claims taken in conjunction with the accompanying drawings, wherein like elements are identified with like symbols, and in which:

DETAILED DESCRIPTION OF THE PRESENT DISCLOSURE

Figure 1A:
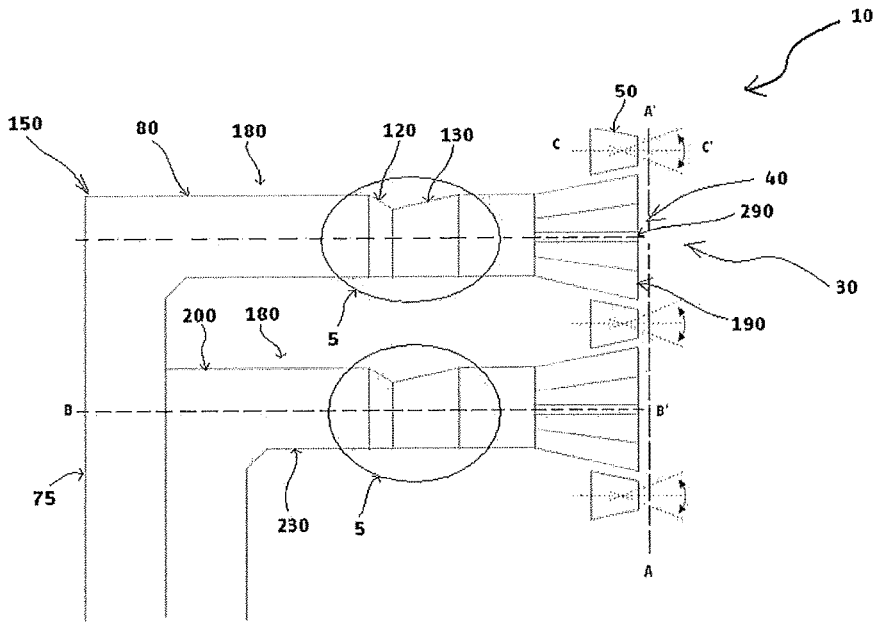
FIG. 1*a* is a side view of a combustion system, in accordance with an exemplary embodiment of the present disclosure.
Figure 1C:
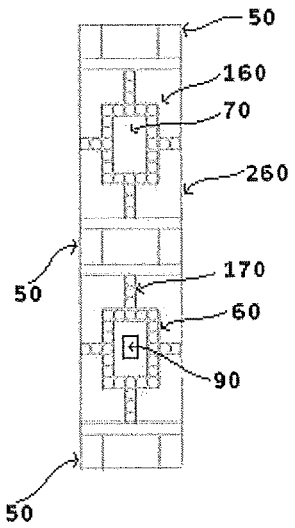
FIG. 1*c* is a front view of outlet of a burner with two fuel nozzles and secondary air nozzles above and below the fuel nozzles in accordance with an exemplary embodiment of the present disclosure.
Figure 1B:
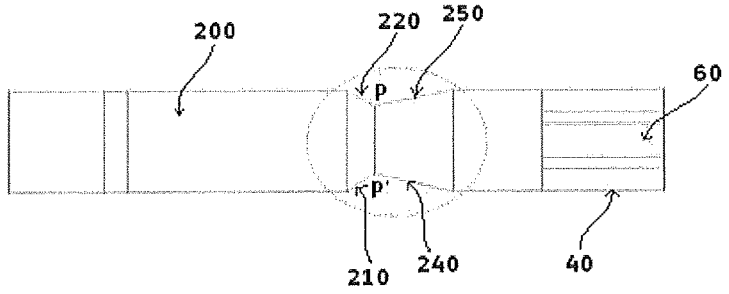
FIG. 1*b* is a top view of the combustion system, in accordance with an exemplary embodiment of the present disclosure.
Figure 3A:
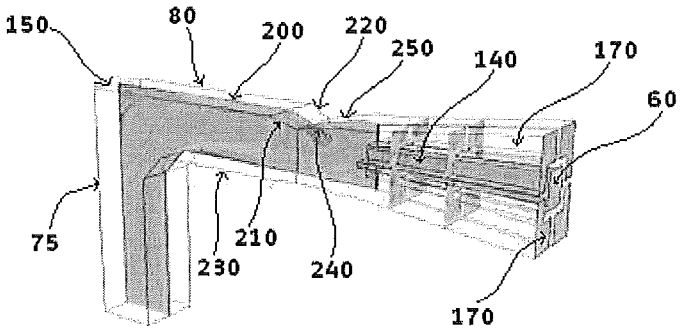
FIG. 3*a* illustrates gas velocities in the burner and at the fuel nozzle in accordance with an exemplary embodiment of the present disclosure.
Figure 3B:
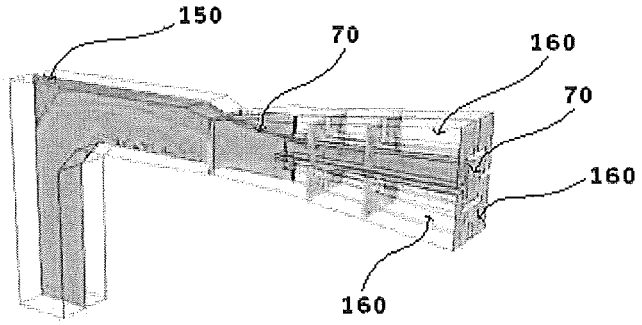
FIG. 3*b* illustrates fuel distribution in the burner and at the air/fuel nozzle in accordance with an exemplary embodiment of the present disclosure.

FIG. 1*a*. shows side view and FIG. 1*b* shows top view of a combustion system 10 having burners 180 which supply a mixed flow of fuel and primary air through at least one fuel nozzle 40 to the combustion chamber 30 for example of a boiler 1. The mixed flow of fuel and primary air supplied to the burner 180 through a duct 150 from a pulverizer (not shown) where the fuel is grinded to the required finesse. The duct 150 is further bends in such a way that one portion is vertical with respect parallel to axis of the boiler 1 A-A is vertical duct 75 and other portion is horizontal duct 80 which is parallel to axis B-B of the fuel nozzle 40. The duct 150 is equipped with a fuel concentrator 5. The fuel concentrator 5 concentrates the mixed flow of fuel and primary air in center 60 of the fuel nozzle 40. Secondary air nozzles 50 are arranged above and below the fuel nozzle 40 to inject an secondary air in order to provide stable combustion of the mixed flow of fuel and primary air in the combustion chamber 30 for example of the boiler 1. An axis C-C' of secondary nozzles 50 is parallel to the axis B-B of the fuel nozzle 40. The fuel nozzle 40 is having a fuel nozzle 190 and core air tubes 290. In one embodiment of the present disclosure the fuel concentrator 5 is having at least one deflector 120 and at least one diverger 130. In another embodiment the deflector 120 has an angle with a wall 200 of duct 150 such that the mixed flow of fuel and air along the wall 200 of the duct 150 is directed towards a center 140 of the duct 150. A sudden change in terms of volume of the duct 150 is provided such that the diameter of the duct 150 has been reduced within range of 50% to 80% of the original diameter and more specifically 65% of the original diameter by angling both sides 210,220 of one wall 200 in a slope converging towards the center of the duct 15 to point P and P'. The other wall 230 of the duct 150 can also be angled from both sides in a slope converging towards the center of the duct 15. Both the walls 200, 230 can also be angled simultaneously in the slope converging towards the center 140 of the duct 150. This sudden change in terms of volume not only change the momentum of fuel particles but also change the direction of the whole mixed flow of fuel and primary air towards the center 140 of the duct 150 and thereafter the mixed flow of fuel and primary air moves in the center 140 of the duct 150. In another embodiment particles having large mass for example coal particles having size more than approximately 200 microns of the concentrated mixed flow of fuel and primary air move in the center 140 of the duct 150 to form a fuel-rich concentrated jet 70 in the center 60 of the fuel nozzle 40 as the change in the velocity does not change the momentum due to the large mass of the particles as shown in FIGS. 3*a* and 3*b*. This leads to continuous motion of the fuel-rich concentrated jet 70 in the center 140 of the duct 150 and further in the center 60 of the fuel nozzle 40 as shown in FIGS. 3*a* and 3*b*. In another embodiment the diverger 130 expands the duct 150 backs to original volume of the duct 150 by angling both sides 240, 250 of the one wall 200 in a slope diverge towards the original diameter of the duct 150 from the point P and P'. The other wall 230 of the duct 150 can be angled from both sides in a slope diverging towards the original diameter of the duct 150. Both the walls 200, 230 can also be angled simultaneously in a slope diverging towards the original diameter of the duct 150. In another embodiment particles having small mass for example coal particles having size less than approximately 200 microns of the concentrated mixed flow of fuel and air again moves along the at least one diverger 130 towards the wall 200 of the duct 150 to form a lean fuel concentrated jet 160 in other sections 170 of the fuel nozzle 40 as shown in FIGS. 3*a* and 3*b*. This change in terms of achieving the original volume provides space for the light particles which due to high momentum start moving along the sides 240, 250, leads to change in the direction of the lean fuel concentrated jet 160 in area near the walls 200, 230 of the duct 150 and further in other sections 170 of the fuel nozzle 40. The duct 150 can be a straight duct with the fuel concentrator 5 equipped anywhere on the duct 150 depending upon the type of fuel and combustion requirements.

For better results the fuel-rich concentrated jet 70 and the lean fuel concentrated jet 160 is generated in the horizontal duct 80 upstream of the fuel nozzle 40 as the changes in velocity and direction leads to the creation and separation of concentrated jet. This position provides an advantage in terms that the fuel-rich concentrated jet 70 is not able to change its direction due to a very short distance which is to traveled before reaching outlet 260 of the fuel nozzle 40 and due to space the lean fuel concentrated jet 160 quickly moves towards the walls 200, 230 of the duct 150 as there is high momentum of the light particles and travel in other sections 170 of the fuel nozzle 40 before reaching the outlet 260 of the fuel nozzle 40. The fuel concentrator 5 can be equipped on any of the walls 200, 230 or on both the walls 200, 230. The fuel concentrator 5 is armored to withstand unavoidable wear. The pressure loss of the fuel concentrator 5 is limited. To enhance the positive effects the burner 180 needs to be combined with tilted secondary air nozzles 50.

FIG. 1*c* illustrates the front view of the outlet 260 of the fuel nozzle 40. The fuel-rich concentrated jet 70 increase the concentration of the mixed flow of fuel and primary air in the center 60 of the fuel nozzle 40 and the lean fuel concentrated jet 160 decrease the concentration of the mixed flow of fuel and primary air in the other section 170 of the fuel nozzle 40. In another embodiment central part 90 of the fuel-rich concentrated jet 70 is ignited in the combustion chamber 30 after it is supplied through outlet 260 of the fuel nozzle 40. The fuel-rich concentrated jet 70 is rich in coal leads to improved gasification of the mixed flow of fuel and primary air and is a key factor in improved NOx emission performance of the burner 180. The combustion system 10 is combined with means to improve mixing of the mixed flow of fuel and primary air with secondary air improves ignition and flame stability.

FIGS. 2*a*, 2*b* 2*c* and 2*d* illustrate the secondary air tilting. By adjusting the angle of the injected secondary air, flame 100 can either be prolonged or shortened.

Figure 2A:
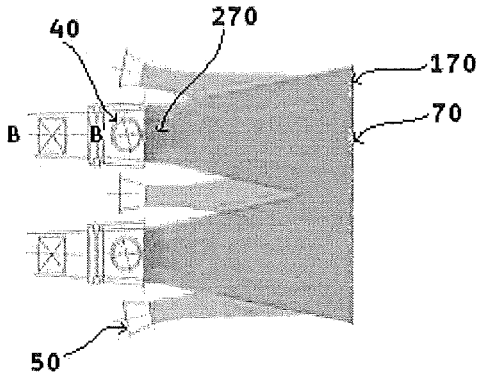
FIG. 2*a-d* illustrates secondary air tilting in accordance with an exemplary embodiment of the present disclosure.

In FIG. 2*a* where in another embodiment the secondary air nozzles 50 are tilted relative to axis B-B of the fuel nozzle 40 to adjust angle of injected secondary air in the combustion of the fuel-rich concentrated jet 70. Secondary air tilting allows further control of the flame 100 and combustion. The secondary air nozzles 50 is tilted in a converging angle towards the axis B-B of the fuel nozzle 40 to combust the mixed flow of fuel and air 20 to obtain a shortened flame 270. Shortening of the flame 100 will enhance ignition and flame stability. This setting will be used either during ignition of the burner 180 or in part-load operation of the burner 180.

Figure 2B:
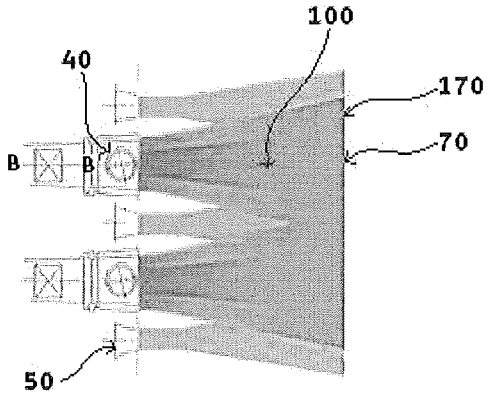

FIG. 2*b* depicts the normal secondary air setting with no deflections at medium burner loads having flame 100.

Figure 2C:
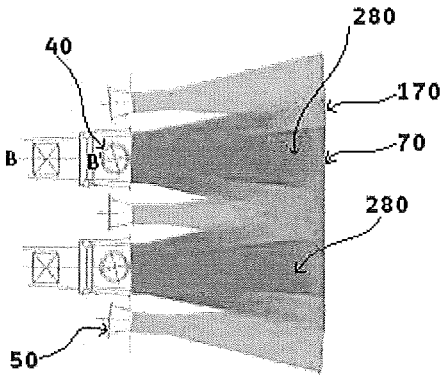

As illustrated in FIG. 2*c*. the secondary air nozzles 50 is tilted in a diverging angle away from the axis B-B of the fuel nozzle 40 to combust the mixed flow of fuel and primary air to obtain a prolonged flame 280. Prolonging of the flame 100 leads will further decrease NOx emissions. The operational mode will be used when the burner 180 is in full load and operation.

Figure 2D:
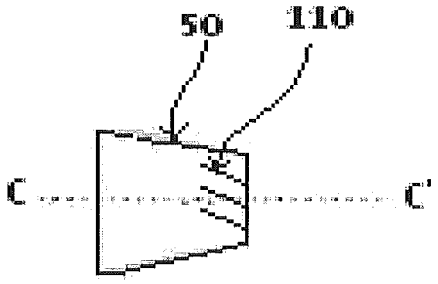

In FIG. 2*d*, Guiding vanes 110 are provided with the secondary air nozzles 50 as an alternative means to deflect the injected secondary air in the combustion of the mixed flow of fuel and primary air.

FIG. 3*a* illustrates gas velocities distribution in the burner 180 and at the fuel nozzle 40, derived from CFD analysis. The gas velocities have been increased in the center 140 of the duct 150 as well as in the center 60 of the fuel nozzle 40 as jet of mixed flow of fuel and primary air is created with the fuel concentrator 5 as observed in form of concentrated mark shown in figure.

As seen in FIG. 3*b* fuel distribution in the burner 180 and at the fuel nozzle 40, derived from CFD analysis. The fuel distribution with fuel-rich concentrated jet 70 has been created in the center 140 of the duct 150 as well as in the center 60 of the fuel nozzle 40 as observed in form of concentrated line shown in figure.

Figure 4:
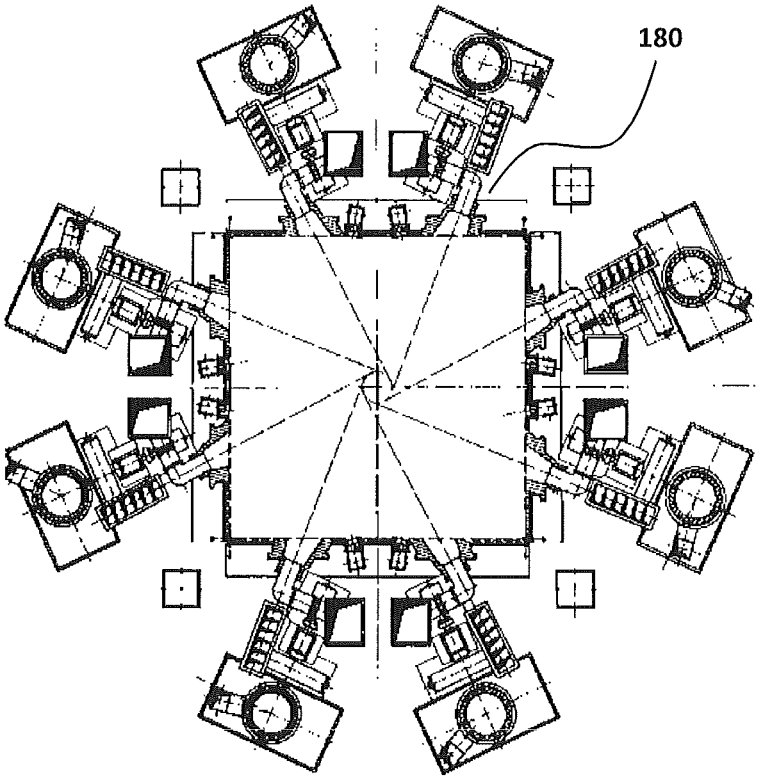
FIG. 4 illustrates top view of a boiler having burners arranged tangentially in accordance with an exemplary embodiment of the present disclosure.

FIG. 4 shows top view of the boiler 1 having burners 180 arranged tangentially with the mixed flow of fuel and air is injected on the boiler walls, representing the arrangement in lignite-fired boilers. The injection of the mixed flow of fuel and air 20 creates a vertical vortex in the center of the combustion chamber.

In a method for combustion according to the present disclosure the mixed of fuel and primary air is supplied through the duct 150 of the burner 180 into the combustion chamber 30 via the fuel nozzle 40. Concentration of the mixed of fuel and air is done by the fuel concentrator 5 in the center 60 of the fuel nozzle 40. Injection of the secondary air controls the combustion of the mixed flow of fuel and air in the combustion chamber 30 through secondary air nozzles which are arranged above and below the fuel nozzle 40. The burner may consist of one or more fuel nozzles 40.

Fuel concentrator 5 is having at least one deflector 120 and at least one diverger 130. The angling of a wall 200 of the at least one deflector 120 directs the mixed flow of fuel and primary air along the wall 200 of the duct 150 towards the center 140 of the duct 150 to the point P and P'. Particles of the mixed flow of fuel and primary air having large mass moves in the center 140 of the duct 150 to form the fuel rich concentrated jet 70 in the center 60 of the fuel nozzle 40. The diverger 130 expand the duct 150 back to the original volume of the duct 150 allowing the movement of particles having small mass of the concentrated mixed flow of fuel and primary air along the at least one diverger 130 towards the wall 200 of the duct 150 to form a lean fuel concentrated jet 160 in other sections 170 of the fuel nozzle 40. Further tilting of the secondary air nozzles 50 relative to the axis B-B' of the fuel nozzle 40 is done to adjust the angle of the injected secondary air in the combustion of the fuel-rich concentrated jet 70 to make the flame 100 either prolonged or shortened. By tilting the secondary air nozzles in the converging angle towards the axis of the fuel nozzle 40 to combust the mixed flow of fuel and air results in the shortened flame 280. Also tilting the secondary air nozzles in the diverging angle away from the axis of the fuel nozzle 40 to combust the mixed flow of fuel and air to obtain a prolonged flame 270.

The burner of the present disclosure is a reliable jet burner in such way to generate a concentrated fuel jet in the center of the fuel nozzle. The mixed flow of fuel and air fuel concentration increases in the center area of the fuel nozzle, while the fuel concentration in the other sections of the fuel nozzle decreases. From a combustion point of view this leads to a prolonged flame with distinct sub- and over-stoichiometric conditions. As a result the burner base NOx emission will be lower. In effect the burner becomes a Low NOx burner. Also the burner firing part load capability has been improved. The burner of the present disclosure sticks to the existing and reliable jet burner design. The burner is compatible with the available mill systems.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above examples teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

The invention claimed is:

1. A combustion system, comprising:

at least one burner to supply a mixed flow of fuel and primary air through at least one fuel nozzle to a combustion chamber;

a horizontal duct located upstream from the at least one fuel nozzle, the duct being equipped with a fuel concentrator having at least one deflector to concentrate the mixed flow of fuel in a center of the at least one fuel nozzle, and at least one diverger disposed immediately downstream of the at least one deflector and a point (P, P') of minimum diameter of the duct interposed between the at least one deflector and the diverger, so as to generate a fuel-rich concentrated jet in the center of the at least one fuel nozzle, wherein the at least one fuel nozzle is further configured to supply the fuel-rich concentrated jet through an outlet of the at least one fuel nozzle to the combustion chamber; and secondary air nozzles arranged above and below the at least one fuel nozzle to inject a secondary air in order to maintain a stable flame in the combustion chamber, wherein a slope of converging sides of the at least one deflector has a larger amount than a slope of diverging sides of the diverger that increase the distance from the point (P, P') of minimum diameter of the duct to an original diameter of the duct;

wherein the diverger has at least one sloped side so that particles having small mass of the concentrated mixed flow of fuel and primary air move along the at least one diverger towards a wall of the duct to form a lean fuel concentrated jet in other sections than the center of the at least one fuel nozzle;

wherein the at least one deflector reduces the distance between the converging sides of the at least one deflector at the point (P, P') of the duct to a range of 50% to 80% of the original distance;

wherein the deflector has only a single sloped side.

2. The combustion system as claimed in claim 1, wherein the at least one deflector has an angle with a wall of duct such that the mixed flow of fuel and primary air along the wall of the duct is directed towards the center of the duct.

3. The combustion system as claimed in claim 2, wherein particles having large mass of the concentrated mixed flow of fuel and primary air move into the center of the duct to form a fuel-rich concentrated jet in the center of the fuel nozzle.

4. The combustion system as claimed in claim 3, wherein the fuel-rich concentrated jet is generated in the horizontal duct upstream of the fuel nozzle.

5. The combustion system as claimed in claim 1, wherein the at least one diverger expands the duct back to original volume of the duct.

6. The combustion system as claimed in claim 1, wherein central part of the fuel-rich concentrated jet is ignited in the combustion chamber.

7. The combustion system as claimed in claim 1, wherein the secondary air nozzles are tilted relative to axis of the fuel nozzle to adjust angle of the injected secondary air in the combustion of the fuel-rich concentrated jet.

8. The combustion system as claimed in claim 7, wherein the secondary air nozzles is tilted in a converging angle towards the axis of the fuel nozzle to combust the mixed flow of fuel and air to obtain a shortened flame.

9. The combustion system as claimed in claim 7, wherein the secondary air nozzles is tilted in a diverging angle away from the axis of the fuel nozzle to combust the mixed flow of fuel and air to obtain a prolonged flame.

10. The combustion system as claimed in claim 1, wherein guiding vanes are provided with the secondary air nozzles to deflect the injected secondary air in the combustion of the mixed flow of fuel and air.

11. The combustion system as claimed in claim 1, wherein the slope of the converging deflector sides is larger than the slope of the diverging diverger sides that increase the distance from the point (P, P') of the duct to the original distance.

12. The combustion system as claimed in claim 1, wherein:

the at least one fuel nozzle has diverging sides such that a cross-sectional area at an outlet end of the at least one fuel nozzle is greater than a cross-sectional area at an inlet end of the at least one fuel nozzle.

13. The combustion system as claimed in claim 1, wherein:

the diverger has only a single sloped side.

14. The combustion system as claimed in claim 1, wherein:

the horizontal duct includes a straight section downstream from the diverger, the straight section being located upstream from the at least one nozzle.

15. The combustion system as claimed in claim 1, wherein:

wherein the secondary air nozzles are each tiltable, simultaneously, towards an axis of the at least one fuel nozzle to decrease a flame length in the combustion chamber.

16. A method for combustion comprising:

supplying a mixed flow of fuel and air by at least one burner through at least one fuel nozzle to a combustion chamber, through a duct being equipped with a fuel concentrator having at least one deflector to concentrate the mixed flow of fuel in a center of the at least one fuel nozzle, and at least one diverger provided immediately downstream the at least one deflector;

injecting secondary air through secondary air nozzles which are arranged above and below the at least one fuel nozzle;

concentrating particles having large mass of the concentrated mixed flow of fuel and primary air in a center of the duct to form a fuel-rich concentrated jet in the center of the at least one fuel nozzle in that an angling of a wall of the at least one deflector directs the mixed flow of fuel and primary air along the wall of the duct towards the center of the duct;

allowing the movement of particles having small mass of the concentrated mixed flow of fuel and primary air along the at least one diverger towards the wall of the duct to form a lean fuel concentrated jet in other sections of the at least one fuel nozzle in expanding the duct back to an original volume of the duct with the at least one diverger;

wherein injecting the secondary air includes injecting the secondary air in order to control combustion of the mixed flow of fuel and primary air in the combustion chamber;

wherein the duct with the fuel concentrator is located upstream from the at least one fuel nozzle; and wherein the at least one deflector and/or the at least one diverger has only a single sloped side for directing the mixed flow of fuel and primary air along the wall of the duct towards the center of the duct, or expanding the duct back to an original volume of the duct, respectively.

17. The method for combustion as claimed in claim 16, further comprising:

tilting the secondary air nozzles relative to axis of the fuel nozzle to adjust angle of the injected secondary air in the combustion of the fuel-rich concentrated jet.

18. The method for combustion as claimed in claim 17, further comprising:

tilting the secondary air nozzles in a converging angle towards the axis of the fuel nozzle to combust the mixed flow of fuel and primary air to obtain a shortened flame.

19. The method for combustion as claimed in claim 17, further comprising:

tilting the secondary air nozzles in a diverging angle away from the axis of the fuel nozzle to combust the mixed flow of fuel and air to obtain a prolonged flame.

* * * * *